US009119422B2

(12) United States Patent
Lance et al.

(10) Patent No.: US 9,119,422 B2
(45) Date of Patent: Sep. 1, 2015

(54) CIGAR CUTTER

(71) Applicants: Daniel C. Lance, Olathe, KS (US); Eric A. Domsch, Olathe, KS (US)

(72) Inventors: Daniel C. Lance, Olathe, KS (US); Eric A. Domsch, Olathe, KS (US)

(73) Assignee: Lujo Concepts, LLC, Olathe, KS (US)

( * ) Notice: Subject to any disclaimer, the term of this patent is extended or adjusted under 35 U.S.C. 154(b) by 0 days.

(21) Appl. No.: 14/486,426

(22) Filed: Sep. 15, 2014

(65) Prior Publication Data

US 2015/0000140 A1 Jan. 1, 2015

Related U.S. Application Data

(63) Continuation-in-part of application No. 13/627,711, filed on Sep. 26, 2012, now abandoned.

(51) Int. Cl.
*A24F 13/26* (2006.01)
*A24F 13/24* (2006.01)

(52) U.S. Cl.
CPC ..... *A24F 13/26* (2013.01); *A24F 13/24* (2013.01)

(58) Field of Classification Search
CPC ..... A24F 13/24; A24F 13/26; B26B 13/16
USPC ..... 30/111, 112, 229, 253, 28, 29; D27/195
See application file for complete search history.

(56) References Cited

U.S. PATENT DOCUMENTS 232,864 A * 10/1880 Wienhold ..... 30/112
235,678 A * 12/1880 Gilman ..... 30/111
242,340 A * 5/1881 Lieb ..... 30/112
318,275 A * 5/1885 McGovern ..... 30/112
325,896 A * 9/1885 Alden ..... 30/112
513,581 A * 1/1894 Pierre ..... 30/112
788,425 A * 4/1905 Parris ..... 30/112
D37,958 S * 4/1906 Dayton ..... D27/195
819,875 A * 5/1906 Garrigus ..... 30/112
826,804 A * 7/1906 Ratcliff ..... 30/112
835,912 A * 11/1906 Obermayer ..... 30/112
838,205 A * 12/1906 Nobs, Jr. ..... 30/112
855,203 A * 5/1907 Schickerling ..... 30/112
876,156 A * 1/1908 Edwards ..... 30/113
921,801 A * 5/1909 Claus ..... 30/112
950,692 A * 3/1910 Garrigus ..... 30/112
959,272 A * 5/1910 Thorne ..... 30/112
1,011,517 A * 12/1911 Stenman ..... 30/112
1,053,890 A * 2/1913 Starck ..... 30/112
1,096,274 A * 5/1914 Simsarian ..... 30/112
1,100,364 A * 6/1914 Fontneau et al. ..... 30/112
1,107,950 A * 8/1914 Holsen ..... 7/158
1,177,098 A * 3/1916 Gay ..... 30/112
1,186,291 A * 6/1916 Davis ..... 30/112
1,294,358 A * 2/1919 Henriot ..... 30/112
D58,175 S * 6/1921 Zapffe ..... D27/195
1,454,994 A * 5/1923 De Matteo ..... 30/112

(Continued)

FOREIGN PATENT DOCUMENTS

FR 1587180 A * 3/1970
FR 2827538 A1 * 1/2003

*Primary Examiner* — Jason Daniel Prone
(74) *Attorney, Agent, or Firm* — Invention Protection Associates, LLC

(57) ABSTRACT

A device for cutting the cap from the head of a premium cigar is disclosed. The cigar cutter is operable between open and closed configurations and includes two pivotally-connected handles with integrated blades and embedded magnets that are arranged to provide opening and closing force for the handles while maintain the structural stability of the device.

12 Claims, 4 Drawing Sheets

(56) References Cited

U.S. PATENT DOCUMENTS

| | | | | | |
|---|---|---|---|---|---|
| 1,504,589 | A | * | 8/1924 | Wagner et al. | 30/112 |
| 1,727,443 | A | * | 9/1929 | Pohlig | 30/112 |
| 1,757,607 | A | * | 5/1930 | Zullo | 30/112 |
| 2,292,729 | A | * | 8/1942 | Woodward | 30/112 |
| 2,523,575 | A | * | 9/1950 | Kassel | 30/112 |
| D244,390 | S | * | 5/1977 | Zimmermann | D27/195 |
| 5,694,691 | A | * | 12/1997 | Chen | 30/112 |
| 5,873,166 | A | * | 2/1999 | Page | 30/111 |
| D410,109 | S | * | 5/1999 | Van Keppel et al. | D27/195 |
| 5,937,523 | A | * | 8/1999 | Van Keppel et al. | 30/112 |
| 6,572,495 | B1 | * | 6/2003 | Ferrari | 131/248 |
| 7,111,402 | B1 | * | 9/2006 | Pearman | 30/158 |
| 7,246,441 | B1 | * | 7/2007 | Collins | 30/160 |
| D577,151 | S | * | 9/2008 | Smith | D27/195 |
| 7,578,062 | B2 | * | 8/2009 | Blackburn | 30/58 |
| D617,496 | S | * | 6/2010 | Wong | D27/195 |
| D630,794 | S | * | 1/2011 | Cohen Harel | D27/195 |
| D637,757 | S | * | 5/2011 | Gutman | D27/195 |
| 2005/0217118 | A1 | * | 10/2005 | Mah | 30/261 |
| 2007/0000133 | A1 | * | 1/2007 | Kasuli | 30/113 |
| 2007/0089299 | A1 | * | 4/2007 | Belaubre | 30/112 |
| 2009/0113719 | A1 | * | 5/2009 | Smith | 30/113 |
| 2010/0257741 | A1 | * | 10/2010 | Lin et al. | 30/112 |
| 2013/0199549 | A1 | * | 8/2013 | Spurling | 131/253 |
| 2014/0082945 | A1 | * | 3/2014 | Lance et al. | 30/112 |

* cited by examiner

CIGAR CUTTER

This application is a continuation-in-part that claims the benefit of nonprovisional application Ser. No. 13/627,711. Furthermore, application Ser. No. 13/627,711 is hereby incorporated by reference.

BACKGROUND OF THE INVENTION

A cigar is a tightly-rolled bundle of dried and fermented tobacco that is ignited so that its smoke may be drawn into the mouth. Cigar tobacco is grown in significant quantities around the world. A typical premium cigar is constructed with three layers of tobacco: filler, binder and wrapper tobacco. The inner layer is the filler tobacco which is bunched to form the main body of the cigar. The binder tobacco is wrapped around the filler bunch and serves to hold the filler tobacco in the desired shape. The wrapper tobacco is the outer layer which is wrapped around the filler and binder. In addition, most quality handmade cigars, regardless of shape, will have a cap which is one or more small pieces of a wrapper pasted onto one end of the cigar with either a natural tobacco paste, vegetable gum or with a mixture of flour and water. The vast majority of premium cigars come with one straight cut end and one end in a cap which must be cut off for the cigar to be smoked. The head of the cigar is the end with the cap applied. Cigars are classified generally by two shape categories: parejo and figurado. Parejo shaped cigars generally have straight sides and a rounded head, whereas figurado shaped cigars are those taking on any other shape. Figurados often have tapered or pointed heads.

A cigar cutter is a mechanical device designed to cut off one or both ends of a cigar so that it may be properly smoked. Most have at least one blade made of steel, and they can be adorned with various accents such as wood.

The cap end of a cigar is the rounded end not having tobacco exposed. It is desirable to remove a portion of the cap in preparation for smoking the cigar. In order to remove a portion of the cap, the cap is typically cut with a cigar cutter or knife, or it is bitten off. Nevertheless, it is critical to cut the head/cap at the appropriate place.

The head of the cigar has a convex, or curved, shape, part of which is called the shoulder. A perfect cut will leave most of the shoulder intact, as it is necessary to remove only a small amount of the wrapper to expose the filler material. Cutting off the entire cigar head will not significantly improve the draw, however, it can cause the wrapper tobacco of the cigar to unravel. Further, if the cap is cut jaggedly or without proper care, problems with the smokeability of the cigar can result. To wit, the end of the cigar may not burn evenly, smokeable tobacco could be lost, the draw (the term commonly used to describe how easily a cigar allows air to pass through it) could be adversely affected and/or the outer wrapper tobacco may unravel. In some cases improperly cutting the cap can render a cigar effectively unsmokeable.

Those of ordinary skill in the art will appreciate that it has long been the practice to cut the cap of a premium cigar utilizing any one of a variety of cutters, such as "guillotine," "double blade," "punch," "scissors," "V-shape" and the like. Each has its benefits and disadvantages as will be described herein.

The guillotine style cutter typically consists of a single blade and a fixed stop that is operable by two fingers between an open and closed configuration. Typically, these are low cost and can cut the cap on any shape cigar up to 54 ring gauge. However, they tend to be difficult to position precisely immediately before and during the cutting action and, as such, are prone to tear the tobacco, rather than cut a cigar cleanly.

The double blade style cutter utilizes two blades that are operable between an open and closed configuration. Typically, this style of cutter features finger or palm grips on the same side of the fulcrum point as the cutting blades. Alternatively, the double blade style cutter may be configured similar to the guillotine style cutter where the blades, that are operable by two fingers, slide into relative engagement along tracks. This style of cutter is less prone to tearing the tobacco and provides a cleaner cut than does the single blade guillotine style cutter. As with the single blade guillotine style cutter, it can be utilized on virtually any shape cigar. However, also like the single blade guillotine style cutter, it can be difficult to position precisely and can lead to cutting too much of the cap and causing the cigar wrapper to unravel.

The punch style cutter consists of a single circular shape blade that is inserted into the cap and removed to create a small hole on the head of the cigar. Punch style cutters typically cut cleanly, but must be used more than once on larger ring gauge cigars to create a larger opening. The punch style cutter is typically relatively small which facilitates portability. However, this type of cutter cannot be used on most figurado cigars.

The scissors style cutter is similar to the double blade cutter relative to its benefits and disadvantages, but typically is two finger-operable with the finger grip locations being on opposite sides of the fulcrum point from blades. This style of cutter typically has an elegant, sophisticated look and can be lightweight and compact.

The V-shape style cutter utilizes a V-shaped blade to cut a substantially triangular cross-sectional plug from the cap of the cigar. This type of cut renders a relatively large cross section of exposed tobacco to draw the smoke through. However as the blade dulls through use, it can damage the cigar while cutting.

Further, it will be appreciate by those of ordinary skill in the art that hand held scissor or guillotine style cigar cutters of the prior art have been designed to be actuated by squeezing two fingers—typically, the thumb and index finger—or the palm of the hand. Both can be difficult to control and can provide an uneven (jagged) cut. These devices often overlook user friendliness in that they provide little or no grip for the user to index the device with their hand.

It is, therefore, desirable for a cigar cutter to possess the following characteristics:

- The cutter must be easy to handle and fit within a user's hand well enough for the cutting edge to be controlled, by a single hand, during the cutting motion. This virtue has been largely overlooked in contemporary cigar cutters.
- The geometry of the cutting surface must lend itself to cutting a wide variety of shapes and sizes of cigars and still produce a high quality cut with-out leaving a wave formation on the cigar head. In this regard, it is important to note that premium cigar smokers rarely smoke only one size of cigar.
- The cigar cutter should be constructed of durable materials. Cigar smoking is often a traditional, generation-bridging practice. Yet, cigar cutters of the prior art rarely get passed down as functioning heirlooms due to mechanical failure.

Thus, those of ordinary skill in the art will appreciate that using a device of the present invention to cut the cap of a premium cigar offers an improvement over conventional cigar cutters.

SUMMARY OF THE INVENTION

The present invention relates generally to a device used to cut the cap from the head of a premium cigar in preparation for smoking. More specifically, the present invention concerns a cigar cutter wherein a portion is gripped by the fingers of one hand and the palm of the same hand and is not only operable between open and closed positions, but it actually urged into either of those positions, alternatively, by the repelling forces exerted by an arrangement of magnets. Furthermore, that magnet arrangement is configured so as to not place unwanted forces on the device that could undermine its structural integrity.

In accordance with a preferred embodiment described herein, a cigar cutter is provided that is comprised of two opposed blades connected at a common fulcrum point and features an arrangement of at least three embedded magnets. The purpose of the magnet arrangement is to: (1) create magnetic repulsion force that alternatively propels the blades, along their parallel pivot planes, toward either the cutter open or closed position, while providing spring-like resistance throughout the range of cutting motion and, then holds them in either position; and separately (2) provide magnetic attraction force that serves as a counterforce to repulsion forces which effectively act on the blades in directions non-parallel to their respective pivot planes and, thereby, prevents the arrangement from affecting the structural stability of the cutter. The magnetic interaction limits the amount of drag on the cutting surface to give the user smoother feedback.

According to an aspect of the present invention, the present cigar cutter is made substantially of hardened stainless steel. In addition to providing a durable edge, the hardened stainless steel construction will provide overall durability consistent with heirloom quality products.

According to another aspect of the invention, a cutting surface is provided that is significantly greater than the size seen on typical double blade cutter, guillotine cutter or cigar scissors. The increased cutting surface is more similar to a guillotina—the cutting instrument used by the cigar roller to trim the foot of the cigar after it has been rolled.

According to yet another aspect of the present invention, the present cigar cutter is designed to be ergonomic, with finger grooves that facilitate superior control during operation.

Various other aspects and advantages of the present invention will be apparent from the detailed description of the preferred embodiments and the accompanying drawing figures. This summary is provided to introduce a selection of concepts in a simplified form that are further described, by way of example, herein below.

DETAILED DESCRIPTION OF THE PREFERRED EMBODIMENTS

Figure 3:
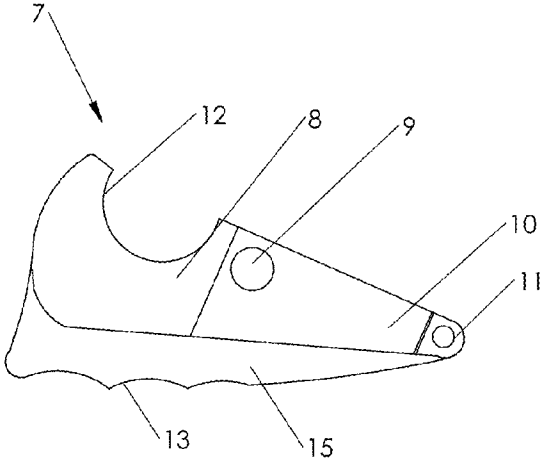
FIG. 3 is an interior elevational view of the second handle of the preferred embodiment of the cigar cutter of the present invention.
Figure 4:
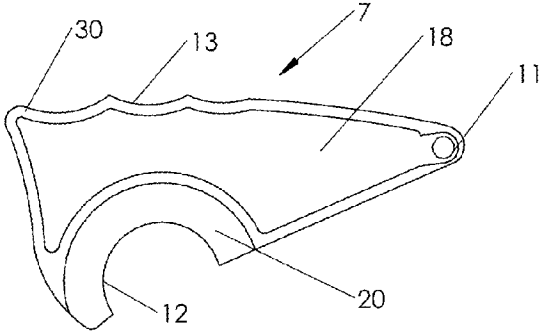
FIG. 4 is an exterior elevational view of said second handle.
Figure 1:
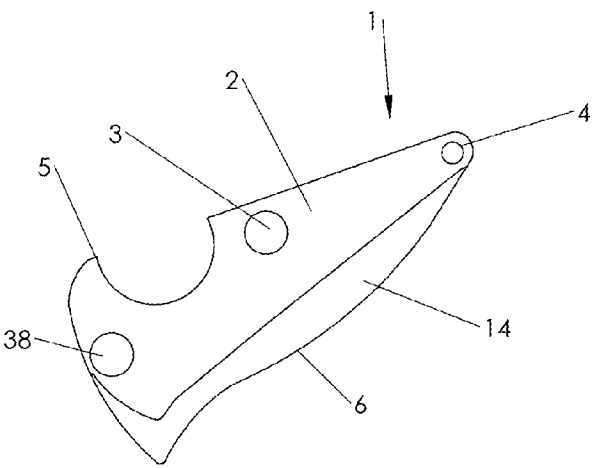
FIG. 1 is an interior elevational view of the first handle of the preferred embodiment of the cigar cutter of the present invention.
Figure 2:
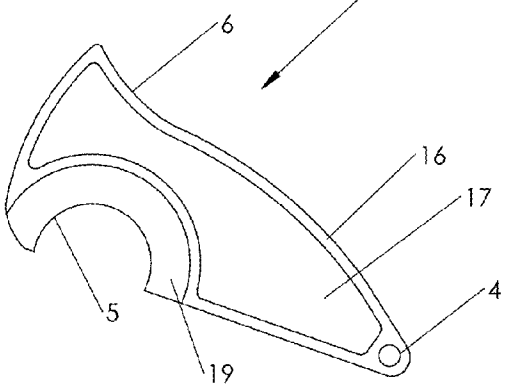
FIG. 2 is an exterior elevational view of said first handle.

Turning initially to FIGS. 1-4, a cigar cutter comprised of handles 1 and 7 is configured to create a double guillotine style cigar cutter for removing all or a portion of a cap of a cigar. Handles 1 and 7 are made at least in part of metal, preferably stainless steel, most preferably 440C stainless steel.

Handle 1 consists of interior face 2, magnet cavities 3 & 38, pivot hole 4, cutting edge 5, palm grip edge 6, face 14, exterior face 16, insert recess 17 and bevel 19. Handle 1 has a total thickness of preferably 0.032" to 0.5", most preferably about 0.250".

Interior face 2 is recessed below the planar surface defined by face 14, preferably to a depth of 0.016" to 0.484" and most preferably about 0.125".

Magnet cavities 3 and 38 are recessed below the planar surface defined by interior face 2—preferably, to depths of 0.016" to 0.468", and most preferably to about 0.062". They each have a diameter of, preferably, 0.062" to 0.5", and most preferably about 0.375". It is also within the ambit of the present invention for either of both magnet cavities 3 & 38 to be polygonal.

Pivot hole 4 is a thru bore with a diameter configured to accept pivot barrel 24.

Insert recess 17 is recessed below the planar face defined by exterior face 16—preferably to a depth of 0.005" to 0.375", and most preferably about 0.050" to accept insert 29. While the preferred embodiment includes insert recess 17, it is also within the ambit of the present invention to eliminate this feature so exterior face 16 is substantially planar.

Handle 7 consists of interior face 8, magnet cavity 9, pivot hole 11, cutting edge 12, finger grip edge 13, face 15, exterior face 30, insert recess 18, bevel 20 and recess 10. Handle 7 has a total thickness of preferably 0.032" to 0.5", and most preferably about 0.250".

Interior face 8 is recessed below the planar surface defined by face 14—preferably to a depth of 0.016" to 0.484", and most preferably about 0.125".

Magnet cavity 9 is recessed below the planar surface defined by interior face 8—preferably to a depth of 0.016" to 0.468", and most preferably about 0.062".

Magnet cavity 9 has a diameter of preferably 0.062" to 0.5", and most preferably about 0.375". It is also within the ambit of the present invention for the magnet cavity 9 to be polygonal.

Pivot hole 11 is a thru bore with a diameter configured to accept pivot barrel 24.

Insert recess 18 is recessed below the planar face defined by exterior face 30—preferably to a depth of 0.005" to 0.375", and most preferably about 0.050" to accept insert 26. While the preferred embodiment includes insert recess 18, it is also within the ambit of the present invention to eliminate this feature so exterior face 30 is substantially planar.

Recess 10 is substantially planar and recessed below the planar surface defined by interior face 8. The surface of recess 10 as depicted in the preferred embodiment is angled to be deeper toward the pivot hole 11 than near the magnet cavity 9, creating clearance to reduce friction forces between interior faces 2 and 8. While recess 10 as depicted is preferred, it is within the ambit of the present invention for the surface of recess 10 to be substantially parallel to the surface defined by interior face 8, and it is also within the ambit of the present invention to eliminate recess 10.

Handles 1 and 7 have integrated cutting edges 5 and 12, respectively, which are made of metal, such as stainless steel, and most preferably 440C stainless steel. Cutting edges 5 and 12, in conjunction with bevels 19 and 20, form the blades of handles 1 and 7, respectively. Handles 1 and 7 are oriented so interior faces 2 and 8 are in substantial engagement and pivot holes 4 and 11 are concentric. Cutting edges 5 and 12 rotate in parallel planes along a radius constrained by an axis through the center of pivot holes 4 and 11, creating the guillotine cutting action within the areas bound by the cutting edges 5 and 12. While it is preferred to have the cutting edged 5 and 12 integrated in to handles 1 and 7, respectively, it is within the ambit of the present invention for cutting edges 5 and 12 to be separate components adhered or fastened to handles 1 and 7.

Handles 1 and 7 include integrated palm grip edge 6 and finger grip edge 13, respectively. Palm grip edge 6 is configured to allow for leverage to be applied to the cutter assembly using the thumb and palm of one hand. Finger grip edge 13 is configured to allow leverage to be applied to the cutter assembly using the fingers of the same hand. While the configurations of the palm grip edge 6 and finger grip edge 13 are preferred, it is also within the ambit of the present invention for these edges to be substantially smooth or otherwise shaped. Further, while it is preferred to have the palm grip edge 6 and finger grip edge 13 integrated into handles 1 and 7, respectively, and it is within the ambit of the present invention for palm grip edge 6 and finger grip edge 13 to be separate components adhered or fastened to handles 1 and 7, respectively.

Figure 6:
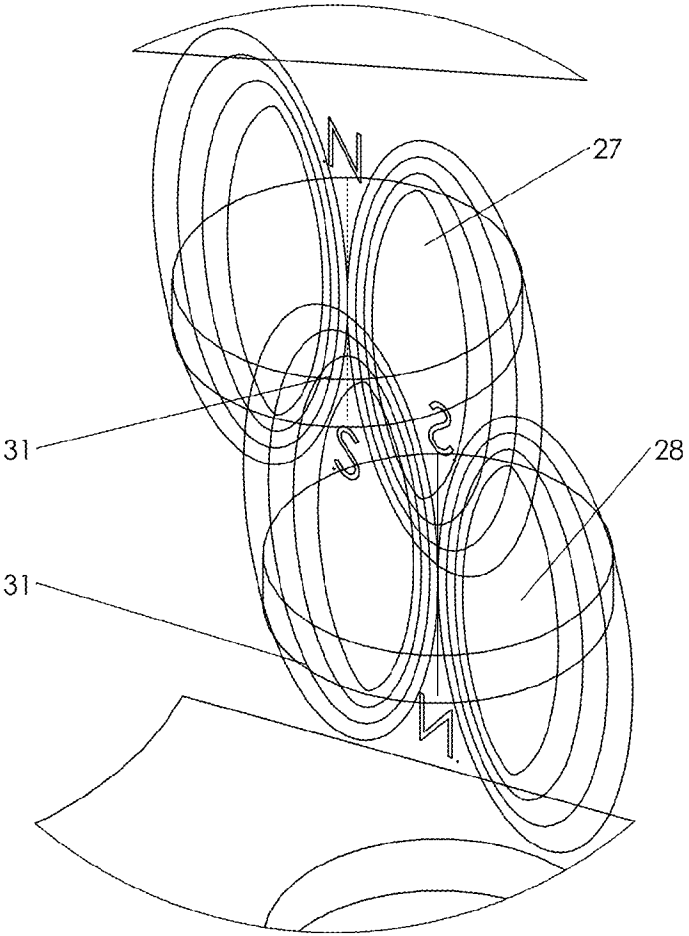
FIG. 6 is a schematic drawing showing the magnetic fields created by and repulsive interaction between two magnets embedded within said first and second handles, respectively.
Figure 5:
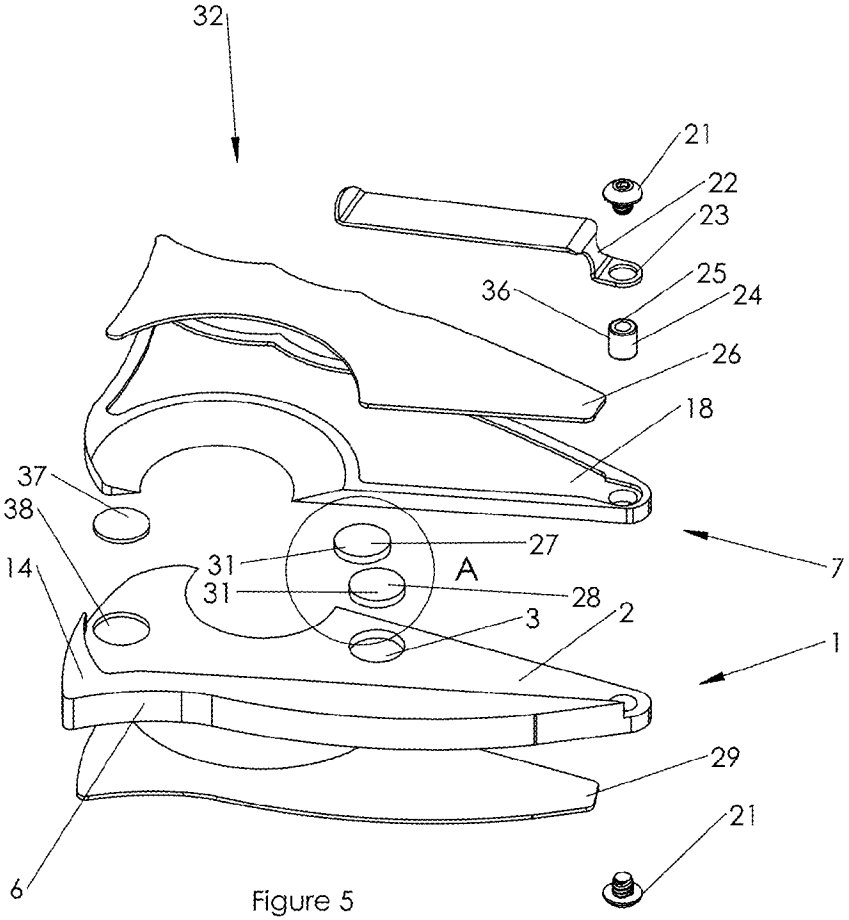
FIG. 5 is a perspective view of said cigar cutter in a fully disassembled state.
Figure 8:
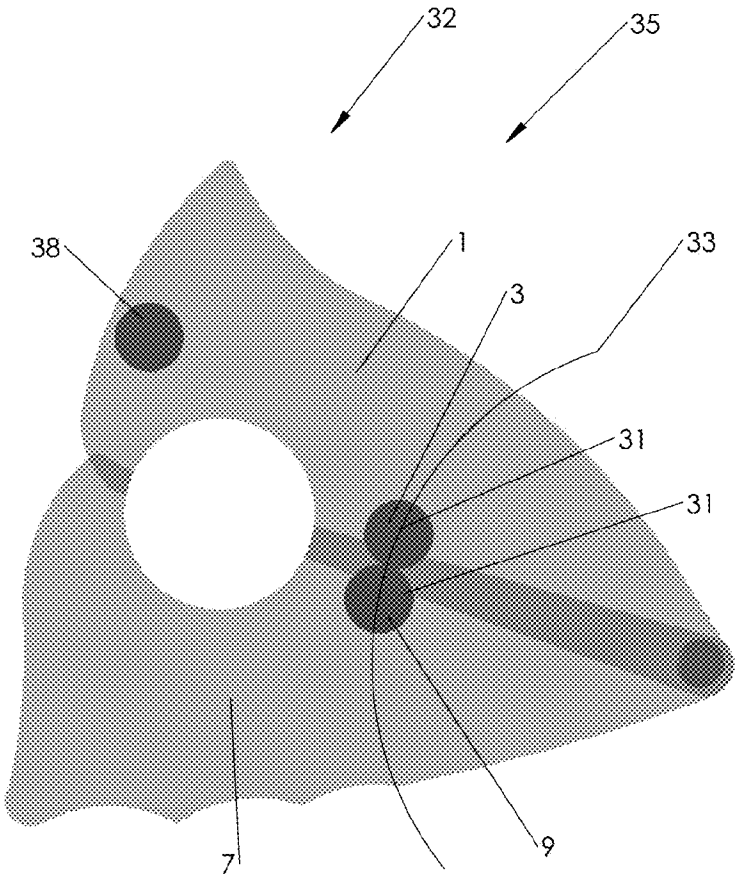
FIG. 8 is an elevational view of said cigar cutter in its open position, showing the relative positioning of said three magnets.

Turning to FIGS. 5 and 6, cutter assembly 32 includes handles 1 and 7, clip 22, inserts 29 and 26, repelling magnets 31, attracting magnet 37, pivot screws 21, and pivot barrel 24. While the preferred embodiment of the current invention is presented, it is within the ambit of the present invention to exclude inserts 29 and 26. It is also within the ambit of the present invention to use an alternative coupling method including, but not limited to, rivets to perform the functions provided by the pivot barrel 24 and pivot screws 21. Further, it is within the ambit of the present invention to exclude clip 22 and/or use a filler block or washer to occupy the area within insert recess 18 configured to accept clip 22.

In accordance with the preferred embodiment, insert 26 is configured to be seated within insert recess 18. Insert 26 may be fastened utilizing an adhesive or fastener. In accordance with the preferred embodiment, insert 26 is comprised of premium decorative materials such as exotic wood, Chinese lacquer, carbon fiber, leather, finished metal or any combination thereof. Insert 26 may also be comprised of rubber, plastic, composites or other materials chosen to improve functional aspects such as grip and scratch resistance as well as aesthetics. Insert 26 may have a smooth or textured surface finish. Also, insert 26 may be configured to fit flush, below and/or above the planar surface defined by exterior face 30. It is also within the ambit of the present invention for insert 26 to be secured to exterior face 30 in the event insert recess 18 is eliminated.

In accordance with the preferred embodiment, insert 29 is configured to be seated within insert recess 17. Insert 29 may be fastened utilizing an adhesive or fastener. Insert 29 may be comprised of premium decorative materials such as exotic wood, Chinese lacquer, carbon fiber, leather, finished metal or any combination thereof. Insert 29 may also be comprised of rubber, plastic, composites or other materials chosen to improve functional aspects such as grip and scratch resistance as well as aesthetics. Insert 29 may have a smooth or textured surface finish. Also, insert 29 may be configured to fit flush, below and/or above the planar surface defined by exterior face 16. It is also within the ambit of the present invention for insert 29 to be secured to exterior face 16 in the event insert recess 17 is eliminated.

Pivot barrel 24 is configured to include threaded hole 25 and bearing surface 36. As depicted in FIG. 5, pivot barrel 24 is inserted into pivot holes 4 and 11 of handles 1 and 7, respectively. Pivot barrel 24 serves as an axial constraint for the rotational movement of handles 1 and 7. Bearing surface 36 engages the bore of pivot holes 4 and 11. Threaded hole 25 is configured to accept the threaded portions of screws 21. Threaded hole 25 is comprised of a thread configuration—preferably between a #2 and a ⅜", coarse or fine thread, and most preferably #6-32. It will be understood by those skilled in the art that the engaging screw threads may also be a metric thread configuration.

Clip 22 is configured to include clip attachment hole 23 and to be seated within insert recess 18. Clip attachment hole 23 aligns with pivot hole 11 and in accordance with the preferred embodiment serves to secure clip 22 to handle 7 utilizing screw 21. Clip 22 is preferably comprised of metal, and most preferably spring stainless steel. However, it is within the ambit of the present invention that clip 22 could be comprised of other materials such as rubber, plastic, wood composite or a combination thereof.

Screws 21 are configured to be inserted through clip hole 23 and pivot holes 4 and 11 and to engage the threaded hole 25 of pivot barrel 24. Screws 21, operating in conjunction with threaded hole 25, provide the lateral clamping force to secure handles 1 and 7 in relative engagement. The threaded portion of screw 21 is comprised of a thread configuration—preferably between a #2 and a ⅜", coarse or fine thread, and most preferably #6-32. It will be understood by those skilled in the art that the engaging screw threads may also be a metric thread configuration.

Repelling magnets 31 are configured to be seated within magnet cavities 3 and 9 of handles 1 and 7, respectively. Means of securing magnets 31 within magnet cavities 3 and 9 include, but are not limited to, fasteners and magnetic attraction. Most preferably, the magnets 31 are secured within magnet cavities 3 and 9 with an adhesive. Magnets 31 are configured to have a diameter of preferably 0.062" to 0.5", and most preferably about 0.375". It is also within the ambit of the present invention for the magnets 31 to be polygonal.

Magnets 31 are comprised of a magnetic north pole face 27 and a magnetic south pole face 28. In accordance with the preferred embodiment, magnets 31 are relatively aligned so that the magnetic fields produced by them interact and put magnets 31 in a repulsion relationship (i.e., the magnetic north pole face 27 of one magnet 31 is aligned to face the magnetic north pole face 27 of the other magnet 31, or the magnetic south pole face 28 of one magnet 31 aligned to face the magnetic south pole face 28 of the other magnet 31).

While the preferred embodiment depicted includes one repelling magnet 31 for each handle 1 and handle 7, it is within the ambit of the present invention to utilize a plurality of such repelling magnets 31 in handles 1 and 7, with at least one pair of magnets relatively aligned in a similar repulsion relationship.

Turning to FIGS. 7-10, in accordance with the preferred embodiment of the present invention, the cutter assembly 32 is shiftable between the closed configuration 34 and open configuration 35. Magnets 31 reside substantially adjacent to one another in parallel planes in the closed configuration 34. Handles 1 and 7 are operable to shift the cutter assembly 32 into the open configuration. In so doing, the magnets 31 move in opposing directions following the path defined by arc path 33. While moving along arc path 33 during the operation from closed configuration 34 to open configuration 35, magnets 31 align to be substantially concentric, then are further shifted to become substantially adjacent in parallel planes aligned opposite to the closed configuration 34 alignment. Similarly, handles 1 and 7 are operable to shift the cutter assembly 32 from the open configuration 35 to the closed configuration 34. The magnets 31 are aligned substantially in a repulsion relationship throughout the range of motion.

Figure 7:
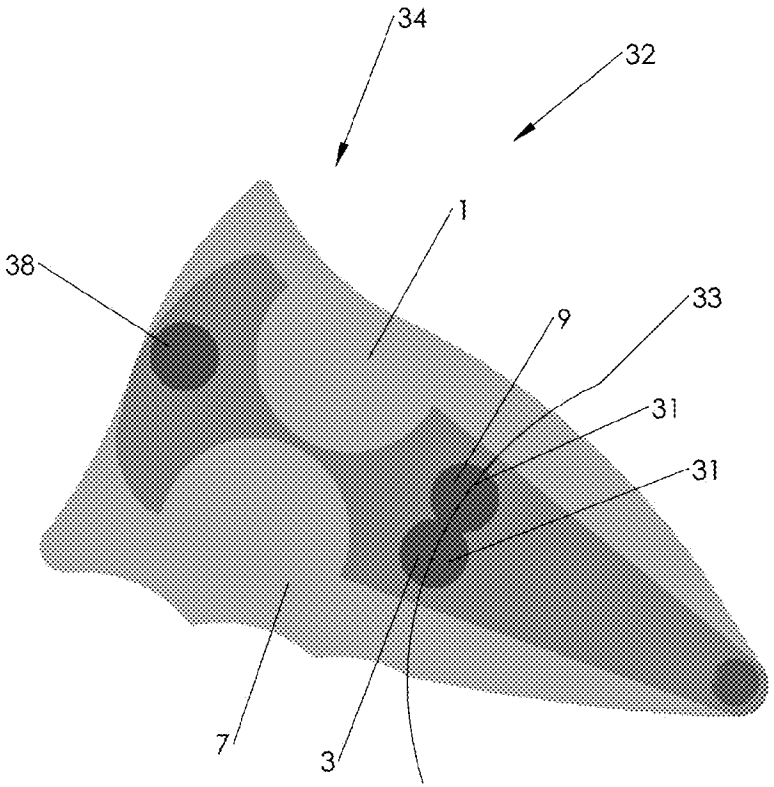
FIG. 7 is an elevational view of said cigar cutter in its closed position, showing the relative positioning of said interacting magnets, as well as a third, non-interacting magnet.
Figure 10:
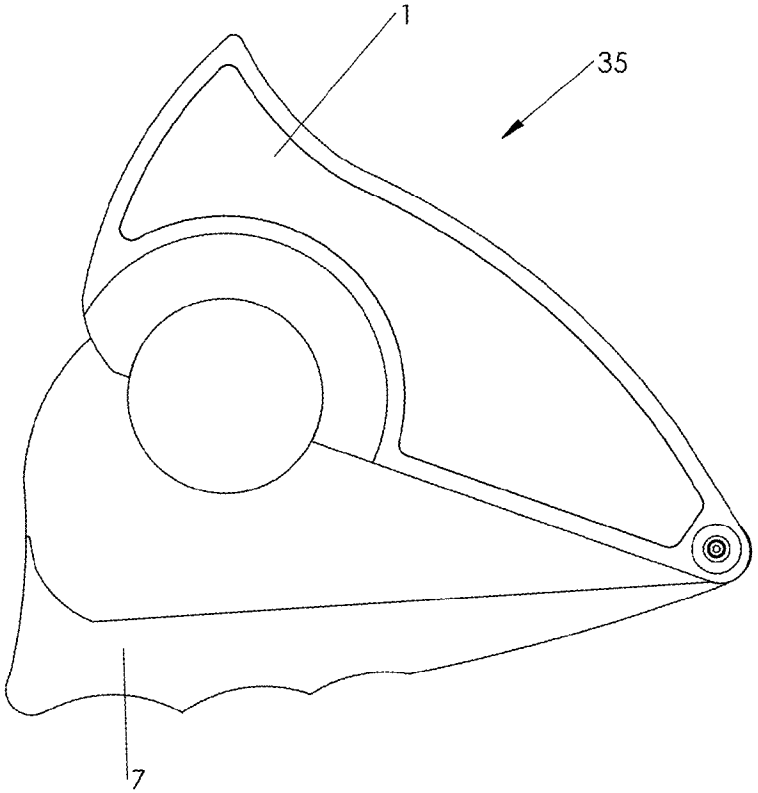
FIG. 10 is another elevational view of said cigar cutter in its open position.
Figure 9:
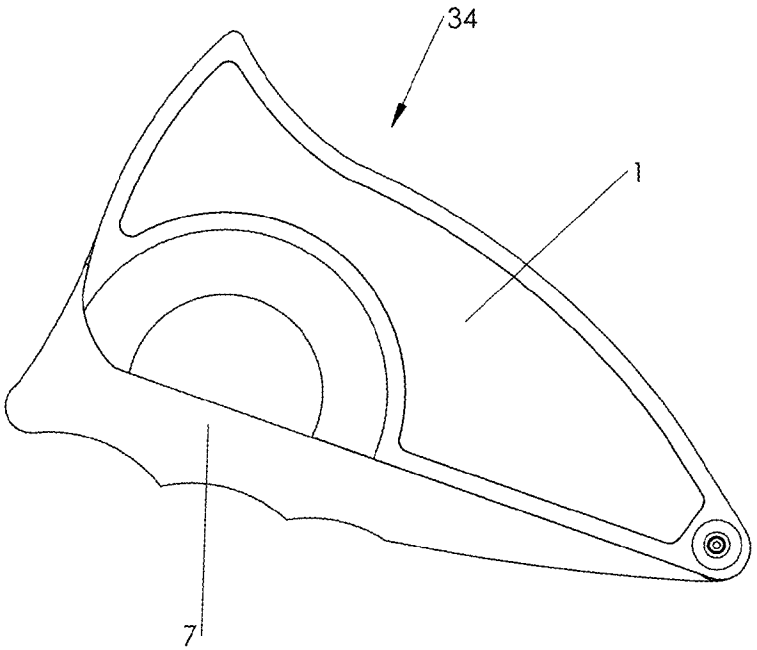
FIG. 9 is another elevational view of said cigar cutter in its closed position.

While in the closed configuration 34 shown in FIG. 7, the repelling forces exerted by magnets 31 against each other, in directions parallel to planes of handle rotation, holds the handles 1 and 7 of cutter assembly 32 in closed position 34. Likewise, while in the open configuration 35 shown in FIG. 8, those repelling forces hold the handles 1 and 7 in open position 35.

Finally, helping to secure handles 1 and 7 in relative lateral engagement is attracting magnet 37. Magnet 37 is configured to be seated within magnet cavity 38 of handles 1. Means of securing magnets 37 within magnet cavities 38 include, but are not limited to, fasteners and magnetic attraction. Most preferably, the magnet 37 is secured within magnet cavity 38 with an adhesive. Magnet 37 is configured to have a diameter of preferably 0.062" to 0.5", and most preferably about 0.375". It is also within the ambit of the present invention for magnet 37 to be polygonal.

The magnetic field produced my magnet 37 exerts an attracting force against the metallic interior face 8 of handle 7. This attracting force is intended to counteract and partially, if not entirely, mitigate the potential effects of undesirable repelling force, in directions perpendicular to the planes of handle rotation, that each of magnets 31 exert against one another and, by extension, against the handle opposite that within which each such magnet 31 is embedded. The opposite handle-attracting magnet 37 is positioned along handle 1 so that its magnetic field never interacts with that of either repelling magnet 31, and particularly not that of the repelling magnet which is positioned along opposing handle 7. Consequently, attracting magnet 37 obviates the need for any unaesthetic frame or other mechanical component to help keep the handles from bowing apart due to laterally-directed repelling forces delivered by each of magnets 31 against opposing handles 1 and 7.

What is claimed is:

1. A cigar cutter that is operable by one hand, the cutter comprising:

a first handle having a first gripping surface, a first cutting blade and a first magnet disposed therealong that produces a first magnetic field;

a second handle having a second gripping surface, a second cutting blade in substantially parallel planar relation to the first cutting blade and a second magnet disposed therealong that produces a second magnetic field;

wherein the handles are pivotally connected and movable, along parallel pivot planes, between open and closed cutter positions, wherein the open position is defined by an opening for receiving a cigar tip existing between respective cutting edges of the cutting blades, and the closed position is defined by the cutting blades being in overlapping relation, and wherein the first and second magnetic fields interact to cause the first and second magnets to exert repelling forces against each other and alternatively bias the handles, along their respective pivot planes, toward the open and closed positions; and a third magnet disposed along the first handle and producing a third magnetic field, wherein the third magnet exerts an attracting force on the second handle in a direction normal to the pivot planes, and wherein said second and third magnetic fields do not interact.

2. The cigar cutter of claim 1, wherein said attracting force in the direction normal to the pivot planes exerted by said third magnet against said second handle mitigates repelling force in a direction normal to the pivot planes exerted by said first magnet against said second handle due to the presence of said second magnet along said second handle.

3. The cigar cutter of claim 1, wherein each said cutting blade is defined by having a flat inner surface and a beveled outer surface, wherein the inner surface of said first cutting blade is in facing relation to the inner surface of said second cutting blade.

4. The cigar cutter of claim 3, wherein said respective cutting edges are arcuate edges at which the inner and outer surfaces of each said blade meet.

5. The cigar cutter of claim 4, wherein said opening for receiving a cigar tip is a circular or elliptical cross-sectional opening when said handle elements are in the open position, but said opening closes as said handles move into the closed position.

6. The cigar cutter of claim 1, wherein said first gripping surface is contoured to receive the palm of the hand and said second gripping surface is contoured to receive the fingers of the hand.

7. A cigar cutter that is operable by one hand, the cutter comprising:

a first handle having a first gripping surface, a first cutting blade and a first magnet disposed therealong that produces a first magnetic field;

a second handle having a second gripping surface, a second cutting blade in substantially parallel planar relation to the first cutting blade and a second magnet disposed therealong that produces a second magnetic field;

wherein the handles are pivotally connected and movable, along parallel pivot planes, between open and closed cutter positions, wherein the open position is defined by an opening for receiving a cigar tip existing between respective cutting edges of the cutting blades, and the closed position is defined by the cutting blades being in overlapping relation, and wherein the first and second magnetic fields interact to cause the first and second magnets to exert repelling forces against each other and alternatively bias the handles, along their respective pivot planes, toward the open and closed positions; and a third magnet disposed along the first handle and producing a third magnetic field, wherein the third magnet exerts an attracting force on the second handle in a direction normal to the pivot planes.

8. The cigar cutter of claim 7, wherein said attracting force in the direction normal to the pivot planes exerted by said third magnet against said second handle mitigates repelling force in a direction normal to the pivot planes exerted by said first magnet against said second handle due to the presence of said second magnet along said second handle.

9. The cigar cutter of claim 7, wherein each said cutting blade is defined by having a flat inner surface and a beveled outer surface, wherein the inner surface of said first cutting blade is in facing relation to the inner surface of said second cutting blade.

10. The cigar cutter of claim 9, wherein said respective cutting edges are arcuate edges at which the inner and outer surfaces of each said blade meet.

11. The cigar cutter of claim 10, wherein said opening for receiving a cigar tip is a circular or elliptical cross-sectional opening when said handle elements are in the open position, but said opening closes as said handles move into the closed position.

12. The cigar cutter of claim 7, wherein said first gripping surface is contoured to receive the palm of the hand and said second gripping surface is contoured to receive the fingers of the hand.

* * * * *